US012398883B2

(12) United States Patent
Schlagmueller et al.

(10) Patent No.: US 12,398,883 B2
(45) Date of Patent: Aug. 26, 2025

(54) FLAME DETECTION DEVICE AND METHOD

(71) Applicant: FEDERAL-MOGUL IGNITION GMBH, Neuhaus-Schierschnitz (DE)

(72) Inventors: Stefan Schlagmueller, Vaihingen-Enz (DE); Jens Wellmann, Bergisch Gladbach (DE)

(73) Assignee: FEDERAL-MOGUL IGNITION GMBH, Neuhaus-Schierschnitz (DE)

( * ) Notice: Subject to any disclaimer, the term of this patent is extended or adjusted under 35 U.S.C. 154(b) by 404 days.

(21) Appl. No.: 18/074,259

(22) Filed: Dec. 2, 2022

(65) Prior Publication Data

US 2023/0184435 A1 Jun. 15, 2023

Related U.S. Application Data

(60) Provisional application No. 63/289,355, filed on Dec. 14, 2021.

(51) Int. Cl.
*F23N 5/20* (2006.01)
*F23N 5/24* (2006.01)
(Continued)

(52) U.S. Cl.
CPC ..... *F23N 5/203* (2013.01); *F23N 5/242* (2013.01); *F23N 5/265* (2013.01); *F23Q 5/00* (2013.01);
(Continued)

(58) Field of Classification Search
CPC ..... F23N 5/203; F23N 5/242; F23N 5/265; F23N 2223/48; F23N 2229/02; F23N 2227/36; F23N 2227/02; F23Q 5/00
(Continued)

(56) References Cited

U.S. PATENT DOCUMENTS 2,153,598 A 4/1939 Steward
4,167,767 A * 9/1979 Courier de Mere ..... H03K 3/57 431/78
(Continued)

FOREIGN PATENT DOCUMENTS

CN 85107394 A 4/1986
CN 108223236 A 6/2018
(Continued)

OTHER PUBLICATIONS

Office Action issued by the CNIPA for application 202211602540.8 on Jun. 13, 2025.

*Primary Examiner* — Avinash A Savani
(74) *Attorney, Agent, or Firm* — Reising Ethington PC

(57) ABSTRACT

A flame detection device that uses a breakthrough voltage across a pair of electrodes located in a flame zone to detect the presence of a flame. The flame detection device may be used with a burner that is part of a furnace in a central heating system for a home or building. Unlike conventional flame detection devices that measure ionization current in a flame, the flame detection device detects a flame by determining the voltage required for a spark event across a spark gap located in a flame zone (also referred to as the breakthrough voltage), and evaluating the breakthrough voltage and/or its various characteristics to detect the presence or absence of a flame. According to one example, the flame detection device includes a power supply, an ignition unit, output wires, insulators, and electrodes.

18 Claims, 2 Drawing Sheets

(51) Int. Cl.
*F23N 5/26* (2006.01)
*F23Q 5/00* (2006.01)

(52) U.S. Cl.
CPC ..... *F23N 2223/48* (2020.01); *F23N 2227/02* (2020.01); *F23N 2227/36* (2020.01); *F23N 2229/02* (2020.01)

(58) Field of Classification Search
USPC ..... 431/78
See application file for complete search history.

(56) References Cited

U.S. PATENT DOCUMENTS

| | | | | | |
|---|---|---|---|---|---|
| 5,577,471 | A * | 11/1996 | Ward | H01T 13/467 123/169 EL | |
| 5,606,118 | A * | 2/1997 | Muth | F02P 17/12 73/35.01 | |
| 5,722,822 | A | 3/1998 | Wilson et al. | | |
| 6,314,803 | B1 | 11/2001 | Pennese et al. | | |
| 7,419,733 | B2 | 9/2008 | Kadowaki et al. | | |
| 9,879,860 | B2 | 1/2018 | Mori | | |
| 10,697,921 | B2 | 6/2020 | Branecky et al. | | |
| 10,731,621 | B2 | 8/2020 | Fiveland | | |
| 2002/0160325 | A1 | 10/2002 | Deng | | |
| 2007/0256426 | A1* | 11/2007 | Dooley | F02P 3/0807 60/776 | |
| 2017/0122281 | A1* | 5/2017 | Imanaka | F02P 3/0892 | |
| 2021/0254826 | A1 | 8/2021 | Kendrick et al. | | |

FOREIGN PATENT DOCUMENTS

| | | | |
|---|---|---|---|
| CN | 110307562 | A | 10/2019 |
| DE | 10153643 | A1 | 5/2003 |
| DE | 102011010074 | A1 | 8/2012 |
| GB | 1396280 | A | 6/1975 |
| GB | 2167210 | A | 5/1986 |
| JP | 5832948 | B2 | 12/2015 |
| JP | 2017166755 | A | 9/2017 |
| KR | 20190060236 | A | 6/2019 |
| WO | WO2021078949 | A1 | 4/2021 |

* cited by examiner

FLAME DETECTION DEVICE AND METHOD

RELATED APPLICATION

This application claims the priority of U.S. provisional application No. 63/289,355, filed Dec. 14, 2021, the entire contents of which are hereby incorporated by reference.

FIELD

The present invention generally relates to sensors and detection devices and, in particular, to flame detection devices that may be used with furnaces, boilers and other equipment that use a flame to burn gaseous and/or liquid fuel.

BACKGROUND

Some conventional flame detection devices, particularly those used in applications that burn natural gas, butane and/or propane, detect the presence of a flame by measuring an ionization current in the flame. However, for applications burning hydrogen, particularly those running at or near 100% hydrogen, detecting a flame by measuring ionization current is typically not feasible. Other flame detection technologies have been developed, such as those that use ultraviolet radiation sensors or thermocouples. These solutions, however, can be costly and can suffer from drawbacks like a delayed time response and reduced durability.

Accordingly, there is a need for a flame detection device that can operate in a variety of settings with different fuels, including those burning at or near 100% hydrogen, but is still cost effective, performs well, and is durable.

SUMMARY

According to one aspect, there is provided a flame detection device, comprising: an ignition unit for providing a high-voltage electrical pulse; one or more output wire(s) for transmitting the high-voltage electrical pulse and being coupled to the ignition unit; and one or more electrode(s) for establishing a spark gap at least partially located in a flame zone and being coupled to the output wire(s), wherein the high-voltage electrical pulse is provided to cause a spark event across the spark gap, and the flame detection device is configured to determine a breakthrough voltage associated with the spark event and to determine the presence of a flame in the flame zone based on the breakthrough voltage.

According to various embodiments, the flame detection device may further include any one of the following features or any technically-feasible combination of some or all of these features:

- the flame detection device is configured for use with a burner that is part of a furnace, a boiler, or a blast furnace;
- the flame detection device is configured for use with at least one gaseous fuel selected from the list consisting of: hydrogen ($H_2$), natural gas ($CH_4$), butane ($C_4H_{10}$), propane ($C_3H_8$), and/or a mixture thereof;
- the ignition unit is coupled to a power supply on an input side and to the output wire(s) on an output side, and the power supply provides the flame detection unit with electrical power;
- the ignition unit includes a step-up transformer with windings on a primary side and with windings on a secondary side, and the step-up transformer is arranged to step-up a voltage of the electrical power from the power supply on the primary side to a voltage in the range of 0.5 kV-30 kV on the secondary side;
- the flame detection device further includes a logic circuit with a combination of sensing and/or processing devices for determining voltages, and the logic circuit is arranged to determine a breakthrough voltage across the electrode(s);
- the logic circuit includes at least one sensing device selected from the list consisting of: a voltmeter, a resistive voltage divider, a capacitive voltage divider, a high-voltage probe, or a field strength sensor;
- the output wire(s) are coupled to the ignition unit on an input side and to the electrode(s) on an output side, and the output wire(s) transmit the high-voltage electrical pulse from the ignition unit to the electrode(s);
- the electrode(s) are coupled to the output wire(s) on an input side and are arranged for positioning near a burner so that the spark gap is located in a flame zone where a flame is expected to be present;
- the spark gap is in a range from 2 mm-8 mm, inclusive; and
- the flame detection device is also configured to act as an ignition electrode such that the flame detection device can both sense when a flame is out and also ignite an air/fuel mixture when needed.

According to another aspect, there is provided a method of using a flame detection device to detect a flame, the flame detection device comprises an ignition unit, one or more output wire(s), and one or more electrode(s), and the method comprises the steps of: initiating a spark event; determining a breakthrough voltage associated with the spark event; and using the breakthrough voltage to determine if a flame is present in a flame zone.

According to various embodiments, the method of using a flame detection device to detect a flame may further include any one of the following features or any technically-feasible combination of some or all of these features:

- the ignition unit is coupled to a power supply on an input side and to the output wire(s) on an output side and includes a step-up transformer; and the initiating step further comprises initiating the spark event by: causing the step-up transformer to increase a voltage of the electrical power from the power supply to a voltage in the range of 0.5 kV-30 kV, providing the increased voltage to the output wire(s) and the electrode(s) in the form of a high-voltage electrical pulse, and causing the high-voltage electrical pulse to create a spark across a spark gap established by the electrode(s), wherein the spark gap is at least partially located in a flame zone;
- the initiating step further comprises periodically initiating the spark event every 20 ms to 500 ms;
- the determining step further comprises determining a breakthrough voltage by: measuring a voltage that is representative of a voltage across the electrode(s) with a sensing device, identifying the highest voltage measured by the sensing device, and setting the breakthrough voltage to the highest measured voltage;
- the using step further comprises using the breakthrough voltage to determine if a flame is present by: comparing the breakthrough voltage to one or more predefined threshold(s), and when the breakthrough voltage is within an expected voltage range established by the predefined threshold(s) then determining that a flame is present, and when the breakthrough voltage is outside of the expected voltage range then determining that a flame is not present;

the predefined threshold(s) are based on an expected type of medium in the spark gap when a flame is present and at least one additional factor selected from the list consisting of: a known size of a spark gap, an expected temperature of the electrode(s) when a flame is present, or an expected pressure of a medium in the spark gap when a flame is present;

the using step further comprises using the breakthrough voltage to determine if a flame is present by: monitoring the breakthrough voltage, determining a rate at which the breakthrough voltage decreases or increases over time, comparing the rate at which the breakthrough voltage decreases or increases to one or more predefined threshold rate(s), and when the rate at which the breakthrough voltage decreases exceeds a predefined threshold rate then determining that a flame is present, and when the rate at which the breakthrough voltage increases exceeds a predefined threshold rate then determining that a flame is not present;

the using step further comprises using the breakthrough voltage to determine if a flame is present by: observing the breakthrough voltage over a period of time, detecting trends or patterns in the breakthrough voltage, and determining if a flame is present or is not present based on the detected trends or patterns;

further comprising the step of: when it is determined that a flame is not present in the flame zone, then taking a remedial step to either shut off a fuel supply or relight the flame.

DRAWINGS

Preferred embodiments will hereinafter be described in conjunction with the appended drawings, wherein like designations denote like elements, and wherein.

DESCRIPTION

The flame detection device disclosed herein uses a breakthrough voltage across a pair of electrodes located in a flame zone to detect the presence of a flame, and it may be used with a wide variety of furnaces, boilers and/or other types of residential and industrial equipment. According to one example, the flame detection device is used with a burner that is part of a furnace in a central heating system for a home or building. In such a system, the burner ignites or burns a gaseous or liquid fuel so that the fuel is converted into heat energy, which in turn is used to heat air or water that can be circulated throughout a home or building. Some non-limiting examples of suitable gaseous fuels include hydrogen ($H_2$), natural gas ($CH_4$), butane ($C_4H_{10}$), propane ($C_3H_8$), and/or a mixture thereof; non-limiting examples of suitable liquid fuels include ethanol, fuel oil and/or other types of oil. Simple furnaces or boilers may include a single burner that burns a single type of fuel, whereas more complex equipment may have multiple burners that fire into a common combustion chamber where different fuels are burned at the same time. Regardless of the system, it is usually important to monitor the state of the flame so that the system can take certain remedial actions, like a gas shutdown, in the event that the flame goes out.

Although the flame detection device is described below in connection with a single burner that is part of a furnace in a central heating system for a home or building, it should be appreciated that the flame detection device may be used in any number of different applications and is not limited to the examples disclosed herein. For example, the flame detection device may be used with hydrogen ($H_2$) burning systems, as well as systems that burn other gaseous and/or liquid fuels (e.g., natural gas ($CH_4$), butane ($C_4H_{10}$), propane ($C_3H_8$) and/or mixtures thereof.); it may be used with single burner systems, as well as complex multi burner systems; it may be used with furnaces in homes or other buildings, as well as with boilers, blast furnaces and other types of residential and/or industrial equipment; it may be used with low-pressure systems, as well as high-pressure systems like those found in jet engines or rocket motors (some of the logic may need to be reversed for such systems, as high voltages can sometimes indicate high pressure and the presence of a flame); and it may be used with continuous combustion systems, as well as intermittent combustion systems such as internal combustion engines and pulse-jet engines (some of the logic may need to be modified for such systems), to cite a few possibilities. It is also possible for the flame detection device to be used in conjunction with other sensors and devices, like thermocouples, pyrometers, optical sensors, infrared sensors, ultraviolet sensors, etc.

Figure 1:
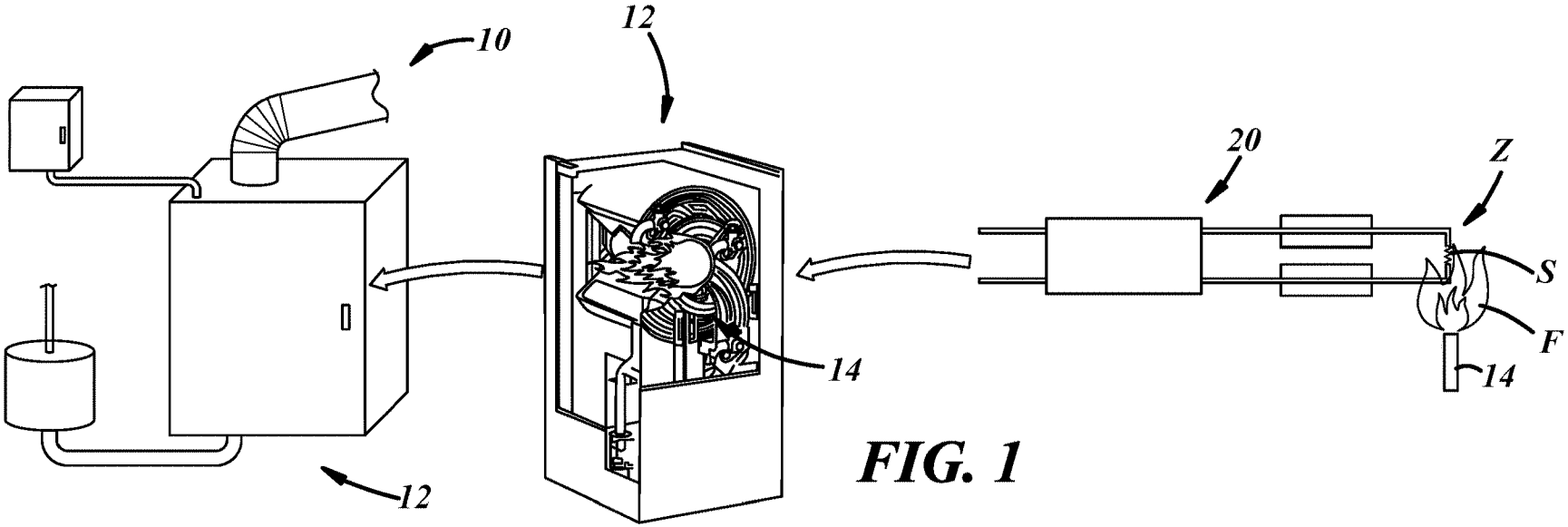
FIG. 1 is a schematic view of an example of a residential heating system.

Turning now to FIG. 1, there is shown an example of a central heating system 10 that runs on hydrogen ($H_2$) and has a furnace 12 with a burner 14 and a flame detection system 20. Unlike conventional flame detection devices that measure ionization current in a flame, the flame detection device 20 detects a flame F by determining the voltage required for a spark event S across a spark gap G that is located in a flame zone Z (also referred to as the breakthrough voltage), and evaluating the breakthrough voltage and/or its various characteristics. According to the example in FIG. 2, the flame detection device 20 includes a power supply 30, an ignition unit 32, output wires 34, insulators 36, and electrodes 38.

Power supply 30 provides the flame detection device 20 with the electrical power needed to operate the device. Depending on the particular application, power supply 30 may supply the flame detection device 20 with AC and/or DC power at anywhere from relatively low voltage levels (e.g., 5V-40V DC), to more moderate voltage levels (e.g., 110V AC) and even higher voltage levels (e.g., 230V AC). Power supply 30 can be configured to provide power according to any number of suitable current types, current levels, voltage levels, etc., and is not limited to the examples cited above. According to one example, the power supply 30 is coupled to an electrical utility or electricity provider at an input side 50 and is coupled to the ignition unit 32 at an output side 52.

Ignition unit 32 generates a high-voltage electrical pulse (e.g., 0.5 kV-30 kV) that meets or exceeds the breakthrough voltage at the spark gap G, which extends between the electrodes 38 and is located in the flame zone Z. The breakthrough voltage mainly depends on four factors: the size of the spark gap G, the temperature of the electrodes 38, the pressure of the medium in the spark gap G, and the composition of the medium in the spark gap G. If the first three factors can generally remain constant (i.e., the size of the spark gap, the temperature of the electrodes, and the pressure of the medium), flame detection device 20 is able to use the fourth factor (the composition of the medium) to detect the presence of a flame, as will be explained. In the example illustrated in FIG. 2, the ignition unit 32 is coupled to the power supply 30 at an input side 60, is coupled to the output wires 34 at an output side 62, and also includes a step-up transformer 64 and a logic circuit 66. The step-up transformer 64 may include any suitable structure and arrangement known in the art, and includes windings on both a primary side 68 and a secondary side 70, and is preferably arranged so that it can step-up the voltage from the power supply 30 to a voltage in the range of 0.5 kV-30 kV. The logic circuit 66 may include any combination of suitable sensing and/or processing devices for determining and/or evaluating breakthrough voltages. For instance, the logic circuit 66 may include a voltmeter, a voltage divider (resistive or capacitive), a high-voltage probe, field strength sensor, and/or other sensing devices for determining the breakthrough voltage at the electrodes 38. The logic circuit 66 may also include a microcontroller, a microprocessor, a central processing unit (CPU), analog-to-digital (ADC) and/or other types of converters, embedded processors, digital signal processors (DSP), application specific integrated circuit (ASIC), and/or other processing devices for evaluating, analyzing and/or determining sensor readings, such as those pertaining to a breakthrough voltage. In one example, the logic circuit 66 includes a voltmeter or voltage divider 72 connected to the secondary side 70 of the step-up transformer 64 so that it can measure the voltage across the electrodes 38, which corresponds to the breakthrough voltage, and it includes an electronic processing device for evaluating and/or analyzing the breakthrough voltage in order to determine if a flame is present. Other components and/or techniques for monitoring, measuring and/or evaluating the breakthrough voltage are certainly possible. It should be appreciated that the logic circuit 66 may be integrated within the ignition unit 32, it may be a separate stand-alone unit that is functionally connected to the ignition unit 32, or it may be provided as a hybrid type of unit that is partially integrated and partially separated (for purposes of the present application, all of these embodiments are considered examples of an ignition unit including a logic circuit).

Output wires 34 and insulators 36 are used to safely connect the output of the ignition unit 32 to the electrodes 38, and may be provided according to any embodiments known in the art. In one non-limiting example, output wires 34 include a pair of standard ignition wires that are able to convey high-voltage electrical pulses (e.g., 0.5 kV-30 kV). As their name suggests, the insulators 36 electrically insulate or isolate the output wires 34 so that they do not short circuit during operation. It is also possible for the insulators 36 to provide a certain degree of thermal insulation, in addition to electrical insulation. According to the non-limiting example of FIG. 2, the output wires 34 are coupled to the ignition unit 32 at an input side 80 and are coupled to the electrodes 38 at an output side 82.

Figure 2:
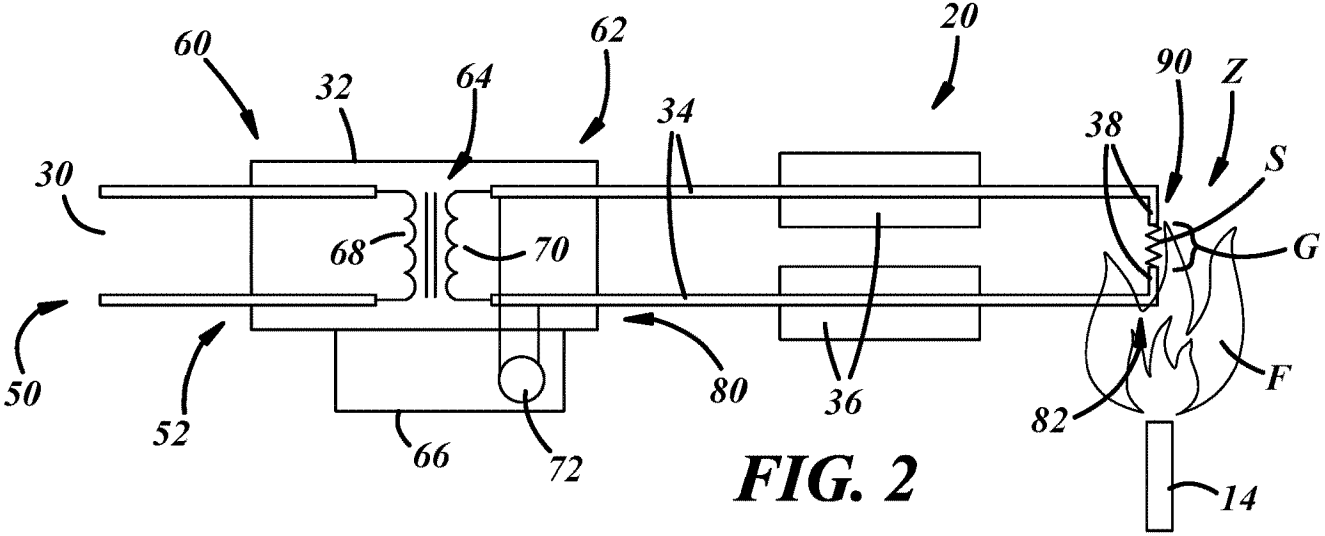
FIG. 2 is a schematic view of a flame detection device that may be used with the residential heating system of FIG. 1.
Figure 3:
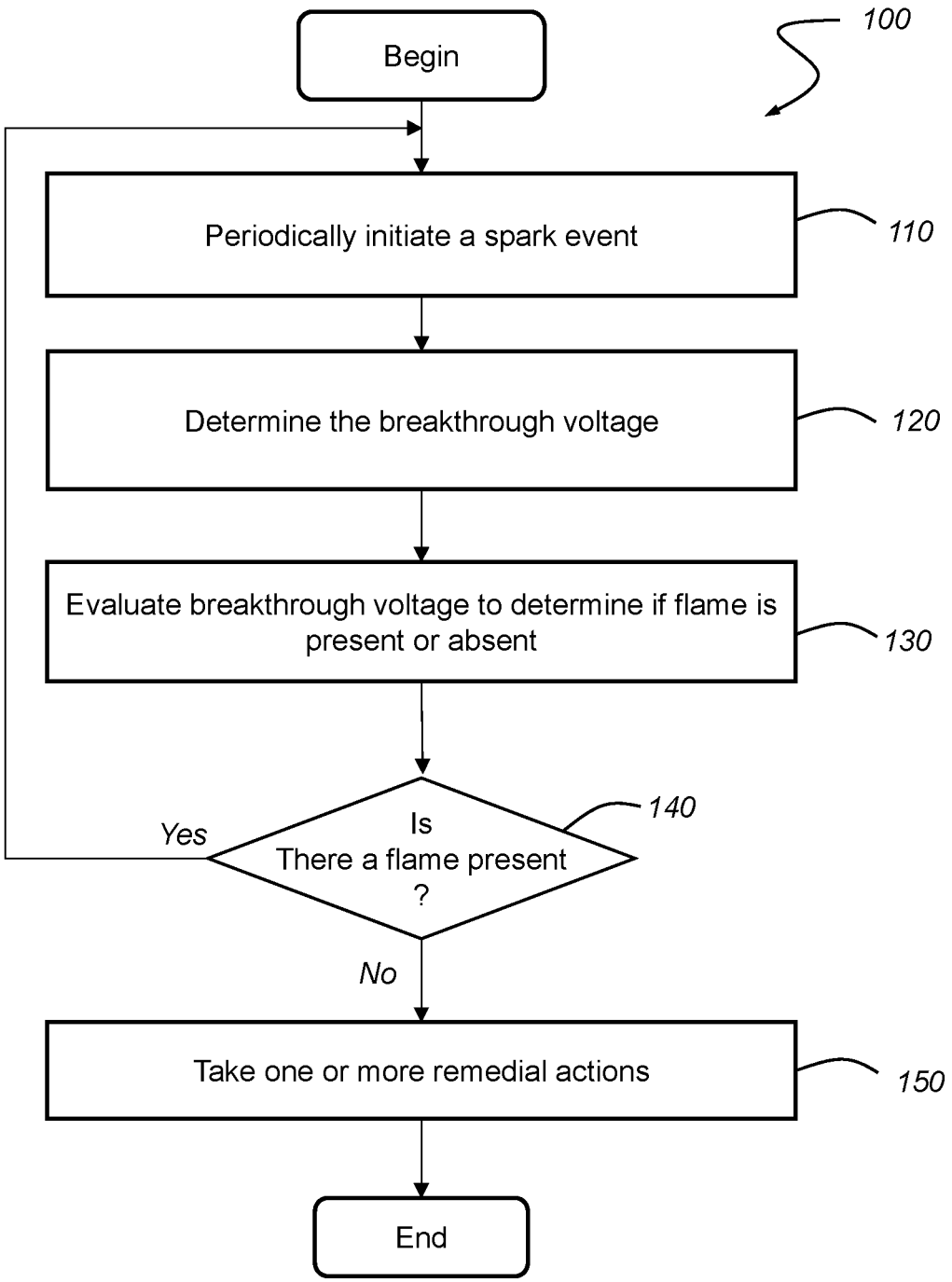
FIG. 3 is a flowchart of a method for detecting a flame that may be used with the flame detection device of FIG. 2.

Electrodes 38 are located in a flame zone Z where a flame F is expected to be present, and they define a spark gap G. One of the electrodes 38 is a positive electrode and the other electrode is a negative or ground electrode, and the electrodes act as sparking elements, between which sparks are formed. The "breakthrough voltage" is the voltage or electric potential across the electrodes 38 that is needed in order for an electrical spark to arc or jump from one electrode to the other. In most cases, the breakthrough voltage is equivalent to the maximum or peak voltage between the electrodes 38 during a spark event and is the primary parameter being monitored in terms of flame detection. The "spark event" may occur during the period of time before spark discharge, during spark discharge and/or after spark discharge. The breakthrough voltage mainly depends on four factors: the size of the spark gap G, the temperature of the electrodes 38, the pressure of the medium in the spark gap G, and the composition of the medium in the spark gap G. The size of the spark gap G can vary by application, but is typically in a range between 2 mm-8 mm, inclusive, and even more preferably between 3 mm-5 mm, inclusive. The shape, orientation and/or arrangement of the electrodes 38 are also factors that can be vary by application; for instance, the electrodes 38 may have tips that are bent in parallel, are oriented tip-to-tip or edge-to-edge, or are arranged so that one electrode sparks directly to a simple pin or electrode that is grounded, to cite a few possibilities. In the last example, where one of the electrodes 38 sparks directly to a grounded object in the furnace 12, like a grounded pin or electrode, the grounded object should be considered an electrode 38, in the context of this application, and the spark gap G is the gap between the one electrode and the grounded object. During operation, the temperature of the electrode(s) 38 can become quite hot (e.g., up to 1,300° C.), which has an effect on the breakthrough voltage. The flame detection device 20 may employ techniques for addressing high electrode temperatures, as discussed below. In the example of FIG. 2, the electrodes 38 are coupled to the output wires at an input side 90 and are positioned near a burner 14 so that they are located in an expected flame zone Z. In the example where one of the electrodes 38 is a grounded object, some modifications to the wiring scheme of the output wires 34 in FIG. 2 may be needed, such as omitting one of the wires; such modifications will be known and understood by those skilled in the art. When a flame F is present, the electrodes 38 should be positioned such that the corresponding spark gap G is at least partially located in the flame F itself.

It is also possible for the flame detection device 20 to double as an ignition electrode, such that it can both sense when the flame is out and also ignite the air/fuel mixture when needed. In such a case, the flame detection device 20 could be mounted in the combustion chamber of a furnace or boiler that is part of a home heating system, for example. Such an arrangement would make additional flame detection units, like those that measure ionization current, unnecessary since a safe ignition electrode is already needed by the system. Other features, embodiments, examples, etc. are possible, as the preceding description is just meant to illustrate some of the possibilities.

In operation, a method of flame detection 100 uses the breakthrough voltage across the spark gap G to determine if a flame F is present. This is a different approach then many conventional flame detection devices, which use ionization current to determine if a flame is present. As indicated above, the breakthrough voltage mainly depends on four factors: the size of the spark gap G, the temperature of the electrodes 38, the pressure of the medium in the spark gap G, and the composition of the medium in the spark gap G. Generally speaking, the first three factors stay rather constant and/or are compensated for (the size of the spark gap G does not change, the temperature of the electrode(s) 38 may change but is compensated for, and the pressure of the medium does not substantially change). This leaves the fourth factor (i.e., the composition of the medium), as the primary factor that can cause appreciable changes to the breakthrough voltage. Thus, the breakthrough voltage is a function, to some degree, of the medium that is present in the spark gap G. The medium in the spark gap G, in turn, is heavily influenced by the presence or absence of a flame (e.g., when there is no flame, there is no combustion, such that the medium is essentially an air/fuel mixture; when there is a flame, there is combustion so that the medium is the byproduct of the combustion process). Accordingly, the breakthrough voltage is a function, to some degree, of the presence of a flame in the area between the electrodes 38. The flame detection device 20 utilizes this function or relationship between the breakthrough voltage across the spark gap G and the presence or absence of a flame F in that same area to determine the state of the flame (i.e., whether the flame is lit, or has gone out).

When a flame F is present between the two electrodes 38, the breakthrough voltage is lower than when no flame F is present between the electrodes. While not wishing to be bound by any particular scientific theory, one potential explanation is because the presence of a flame in the spark gap G means that there will be byproducts of the combustion process in that area. For example, in the case of hydrogen ($H_2$) combustion, the byproduct is generally water vapor ($H_2O$); and in the cases of natural gas ($CH_4$), propane ($C_3H_8$) and butane ($C_4H_{10}$) combustions, the byproducts are primarily carbon dioxide ($CO_2$) and water vapor ($H_2O$). In each of these cases, the byproducts of the combustion process, which include water vapor ($H_2O$), may be more susceptible to electric breakdown than the original fuels themselves. This means that, when there is a flame present between the electrodes 38 (whether it be between two electrodes or between an electrode and a grounded object), the medium in the spark gap G may be more susceptible to electric breakdown so that the voltage required to jump from one electrode to the other (i.e., the breakthrough voltage) is lower. The flame detection device 20, as well as the method described herein, is able to monitor, measure and/or evaluate the breakthrough voltage, as described below. As already stated, the present application is not bound by or limited to the potential explanation above. Factors other than or in addition to "susceptibility to electric breakdown" (e.g., factors associated with byproducts of combustion, gas temperatures, free ions or electrons, etc.) could influence the breakthrough voltage at the spark gap G and should be considered part of or incorporated into the present application.

Starting with step 110, the method periodically initiates a spark event so that the flame detection device 20 can evaluate the measured breakthrough voltage. Some initial testing has shown that a typical reaction time for the breakthrough voltage, following a change in status of the flame F (i.e., either the flame going out, or the flame being lit), is less than 60 ms. Thus, the present method may initiate a spark event, and hence execute a new cycle or iteration of the method, every 20 ms to 500 ms. It should be appreciated that any suitable spark event period may be used, as the present method is not limited to the examples above.

Next, the method determines the breakthrough voltage, which corresponds to the voltage across the electrodes 38 when an electrical spark arcs or jumps from one electrode to the other, step 120. Since the breakthrough voltage is equivalent to the maximum or peak voltage between the electrodes 38 during a spark event, step 120 may monitor the voltage at the secondary side 70 (same as the voltage at the electrodes 38) with voltage sensor 66 and simply record the highest voltage measured during the period in question; such a voltage would correspond to the breakthrough voltage. In a different example, step 120 may monitor the voltage at the secondary side 70 and record the course of the voltage over a period of time; this enables the method to not only evaluate breakthrough voltages in terms of absolute values, but also to evaluate breakthrough voltages in terms of how they change over time (i.e., to evaluate breakthrough voltage patterns, levels, courses, etc.). Any number of different voltage determining or gathering techniques may be used, as the present method is not limited to any particular one.

In step 130, the method evaluates the breakthrough voltage to determine if a flame is present or absent. This step may be carried out in any number of different ways. In a first example, step 130 may compare previously determined breakthrough voltage(s) to one or more predefined threshold(s). If the breakthrough voltage(s) is within an expected voltage range established by the predefined threshold(s), then the method may conclude that a flame is present; if the breakthrough voltage is outside of the expected voltage range, then the method may determine that the flame has gone out and the method can take some type of remedial step to shut off the fuel or relight the flame. For instance, if the previously determined breakthrough voltage is less than a predefined threshold, which can be based on the specifics of that particular application (i.e., the threshold could be based on the known size of the spark gap G, the expected temperature of the electrodes when a flame is present, and the expected pressure and type of medium that should be present when a flame is present), then step 130 may determine that the flame F is present. If the breakthrough voltage is equal to or greater than the predefined threshold, then step 130 may conclude that the flame F is out. While it is possible for the predefined threshold(s) to be a static value saved in an electronic memory component of the flame detecting device 10, it may be advantageous for the predefined threshold(s) to be a dynamic value that is periodically updated or adjusted (e.g., based on closed loop feedback, machine learning techniques, etc.). Some factors that could be considered for updating or adjusting dynamic thresholds include the condition of the burner 14, parameters sensed by other sensors in the system, or changes in the breakthrough voltage itself, to cite a few possibilities.

In a second example, step 130 evaluates the breakthrough voltage to determine the presence or absence of a flame F by looking at how the breakthrough voltage changes over time. If the breakthrough voltage decreases at a rate that is greater than a predefined threshold rate, then step 130 may conclude that the flame F has just been lit. Conversely, if the breakthrough voltage increases at a substantial rate that exceeds some threshold rate, then step 130 may determine that the flame has just gone out. Small changes in the breakthrough voltage, such as those that do not exceed an upper and/or lower threshold rate boundary, are to be expected and will typically result in step 130 concluding that the flame F is still in the same state (e.g., that the flame is still lit). Of course, the present method may use a combination of techniques, such as a combination of the first and second examples above, to evaluate the breakthrough voltage(s) and determine if a flame is present or not. In some instances, the method may make such determinations based on a single cycle of the method (i.e., based on a single spark event and a single measured breakthrough voltage), whereas in other instances the method may average breakthrough voltages over a period of cycles and use the averages in the evaluation.

It is possible that step 130 will need to compensate for changes in the temperature of the electrodes. As mentioned above, one of the four main factors that can impact the breakthrough voltage is the temperature of the electrode(s) 38, which can get rather hot (up to about 1,300° C.) during operation considering that the electrodes are positioned at least partially within the flame F. The higher the temperature of the electrode(s) 38, the lower the breakthrough voltage. It is even possible, in some outlier situations, for the electrode temperature to get so hot that its influence, in terms of being a factor that dictates the breakthrough voltage, is equivalent to the medium between the electrodes (i.e., the presence of a flame). In such cases, additional precautions may be helpful in terms of mitigating or reducing the effect or influence of electrode temperature as a factor in determining breakthrough voltage. One example of such a precaution is to increase the size of the spark gap G, which has the effect of increasing the weight of the presence of a flame as a factor. If the spark gap G is increased enough, the influence that the presence of a flame will have on breakthrough voltage is substantially higher than the influence that electrode temperature has. Another example of a precaution that can be used to address the issue of extreme electrode temperature is to continuously observe the breakthrough voltage over a period of time and/or cycles, as opposed to examining the breakthrough voltage on a per cycle basis alone. This technique is similar to the second example above, where the method observes the breakthrough voltage over a period of time in order to see trends or patterns in the voltage that would indicate when a flame is being lit or going out. Another possibility is to conduct a detailed analysis of the coarse/leveling/integrals of the voltage demand over a period of time. Not only does the breakthrough voltage change in the presence of a flame, so does the corresponding current. Analyzing one or both of breakthrough voltage and/or current and their leveling over time could also help detect the loss of a flame, even when the electrodes are at elevated temperatures.

If a flame is present, then step 140 sends the method back to step 110 for continued monitoring. If a flame is not present, then step 140 directs the method to step 150 so that one or more remedial actions can be taken. If the flame went out unexpectedly, step 150 could perform a gas shutoff or attempt to relight the flame, assuming appropriate safety procedures have been followed. Other remedial actions, such as sending warnings, etc. are certainly possible as well.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, the exact size, shape, composition, etc. of a thermal coupling zone covered could vary from the disclosed examples and still be covered by the present application (e.g., micrographs of actual parts could appear substantially different from the illustrated drawings, yet still be covered). All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

What is claimed is:

1. A flame detection device, comprising:

an ignition unit for providing a high-voltage electrical pulse;

one or more output wire(s) for transmitting the high-voltage electrical pulse and being coupled to the ignition unit; and one or more electrode(s) for establishing a spark gap at least partially located in a flame zone and being coupled to the output wire(s), wherein the high-voltage electrical pulse is provided to cause a spark event across the spark gap, the flame detection device is configured to determine a breakthrough voltage associated with the spark event and to compare the breakthrough voltage to one or more predefined threshold(s), and the predefined threshold(s) are based on an expected type of medium in the spark gap when a flame is present and at least one additional factor selected from the list consisting of: a known size of the spark gap, an expected temperature of the electrode(s) when a flame is present, or an expected pressure of a medium in the spark gap when a flame is present, when the breakthrough voltage is within an expected voltage range established by the predefined threshold(s), then the flame detection device is configured to determine that a flame is present in the flame zone, and when the breakthrough voltage is outside of the expected voltage range, then the flame detection device is configured to determine that a flame is not present in the flame zone.

2. The flame detection device of claim 1, wherein the flame detection device is configured for use with a burner that is part of a furnace, a boiler, or a blast furnace.

3. The flame detection device of claim 1, wherein the flame detection device is configured for use with at least one gaseous fuel selected from the list consisting of: hydrogen ($H_2$), natural gas ($CH_4$), butane ($C_4H_{10}$), propane ($C_3H_8$), and/or a mixture thereof.

4. The flame detection device of claim 1, wherein the ignition unit is coupled to a power supply on an input side and to the output wire(s) on an output side, and the power supply provides the flame detection unit with electrical power.

5. The flame detection device of claim 4, wherein the ignition unit includes a step-up transformer with windings on a primary side and with windings on a secondary side, and the step-up transformer is arranged to step-up a voltage of the electrical power from the power supply on the primary side to a voltage in the range of 0.5 kV-30 kV on the secondary side.

6. The flame detection device of claim 4, wherein the flame detection device further includes a logic circuit with a combination of sensing and/or processing devices for determining voltages, and the logic circuit is arranged to determine a breakthrough voltage across the electrode(s).

7. The flame detection device of claim 6, wherein the logic circuit includes at least one sensing device selected from the list consisting of: a voltmeter, a resistive voltage divider, a capacitive voltage divider, a high-voltage probe, or a field strength sensor.

8. The flame detection device of claim 1, wherein the output wire(s) are coupled to the ignition unit on an input side and to the electrode(s) on an output side, and the output wire(s) transmit the high-voltage electrical pulse from the ignition unit to the electrode(s).

9. The flame detection device of claim 1, wherein the electrode(s) are coupled to the output wire(s) on an input side and are arranged for positioning near a burner so that the spark gap is located in a flame zone where a flame is expected to be present.

10. The flame detection device of claim 9, wherein the spark gap is in a range from 2 mm-8 mm, inclusive.

11. The flame detection device of claim 1, wherein the flame detection device is also configured to act as an ignition electrode such that the flame detection device can both sense when a flame is out and also ignite an air/fuel mixture when needed.

12. A method of using a flame detection device to detect a flame, the flame detection device comprises an ignition unit, one or more output wire(s), and one or more electrode(s), and the method comprises the steps of:

initiating a spark event;

determining a breakthrough voltage associated with the spark event; and using the breakthrough voltage to determine if a flame is present in a flame zone by: comparing the breakthrough voltage to one or more predefined threshold(s), and when the breakthrough voltage is within an expected voltage range established by the predefined threshold(s) then determining that a flame is present, and when the breakthrough voltage is outside of the expected voltage range then determining that a flame is not present, wherein the predefined threshold(s) are based on an expected type of medium in a spark gap when a flame is present and at least one additional factor selected from the list consisting of: a known size of the spark gap, an expected temperature of the electrode(s) when a flame is present, or an expected pressure of a medium in the spark gap when a flame is present.

13. The method of claim 12, wherein the ignition unit is coupled to a power supply on an input side and to the output wire(s) on an output side and includes a step-up transformer; and the initiating step further comprises initiating the spark event by: causing the step-up transformer to increase a voltage of the electrical power from the power supply to a voltage in the range of 0.5 kV-30 kV, providing the increased voltage to the output wire(s) and the electrode(s) in the form of a high-voltage electrical pulse, and causing the high-voltage electrical pulse to create a spark across the spark gap established by the electrode(s), wherein the spark gap is at least partially located in a flame zone.

14. The method of claim 12, wherein the initiating step further comprises periodically initiating the spark event every 20 ms to 500 ms.

15. The method of claim 12, wherein the determining step further comprises determining the breakthrough voltage by: measuring a voltage that is representative of a voltage across the electrode(s) with a sensing device, identifying the highest voltage measured by the sensing device, and setting the breakthrough voltage to the highest measured voltage.

16. A method of using a flame detection device to detect a flame, the flame detection device comprises an ignition unit, one or more output wire(s), and one or more electrode(s), and the method comprises the steps of:

initiating a spark event;

determining a breakthrough voltage associated with the spark event; and using the breakthrough voltage to determine if a flame is present in a flame zone by: monitoring the breakthrough voltage, determining a rate at which the breakthrough voltage decreases or increases over time, comparing the rate at which the breakthrough voltage decreases or increases to one or more predefined threshold rate(s), and when the rate at which the breakthrough voltage decreases exceeds a predefined threshold rate then determining that a flame is present, and when the rate at which the breakthrough voltage increases exceeds a predefined threshold rate then determining that a flame is not present.

17. A method of using a flame detection device to detect a flame, the flame detection device comprises an ignition unit, one or more output wire(s), and one or more electrode(s), and the method comprises the steps of:

initiating a spark event;

determining a breakthrough voltage associated with the spark event; and using the breakthrough voltage to determine if a flame is present in a flame zone by: observing the breakthrough voltage over a period of time, detecting trends or patterns in the breakthrough voltage, and determining if a flame is present or is not present based on the detected trends or patterns.

18. The method of claim 12, further comprising the step of:

when it is determined that a flame is not present in the flame zone, then taking a remedial step to either shut off a fuel supply or relight the flame.

* * * * *